United States Patent [19]

Kato

[11] Patent Number: 4,489,886

[45] Date of Patent: Dec. 25, 1984

[54] FUEL INJECTION APPARATUS

[75] Inventor: Masaaki Kato, Toyoake, Japan

[73] Assignee: Nippondenso Co., Ltd., Kariya, Japan

[21] Appl. No.: 423,308

[22] Filed: Sep. 24, 1982

[30] Foreign Application Priority Data

Oct. 5, 1981 [JP] Japan ..... 56-148026

[51] Int. Cl.[3] ..... F02M 51/00

[52] U.S. Cl. ..... 239/88; 239/95; 239/124

[58] Field of Search ..... 239/88, 89, 90, 91, 239/95, 96, 533.2–533.12; 237/124

[56] References Cited

U.S. PATENT DOCUMENTS

| | | | |
|---|---|---|---|
| 2,788,246 | 4/1957 | Nichols | 239/96 |
| 4,129,253 | 12/1978 | Bader, Jr. et al. | 239/88 |
| 4,129,254 | 12/1978 | Bader, Jr. et al. | 239/96 |
| 4,235,374 | 11/1980 | Walter et al. . | |
| 4,378,774 | 4/1983 | Kato | 239/88 |
| 4,385,609 | 5/1983 | Kato | 239/88 |
| 4,399,793 | 8/1983 | Poore et al. | 239/95 |

FOREIGN PATENT DOCUMENTS 50726 4/1979 Japan .

*Primary Examiner*—Andres Kashnikow
*Assistant Examiner*—Jon M. Rastello
*Attorney, Agent, or Firm*—Cushman, Darby & Cushman

[57] ABSTRACT

A fuel injection apparatus includes a pumping plunger operated in synchronism with an engine and a pumping cylinder into which the pumping plunger is inserted. A pump chamber is defined by the pumping plunger and pumping cylinder. An injection plunger operated by a hydraulic pressure in the pump chamber is inserted into an injection cylinder leading to the pump chamber to define an injection pump chamber. Fuel supplied from a fuel source is, after adjusted to a predetermined amount, supplied to the injection pump chamber. A fuel return passage is connected to the pump chamber and a blocking mechanism is disposed on the fuel return passage to block the passage at an optimal fuel injection time of an engine. The fuel in the pump chamber is discharged by a discharge mechanism at the fuel injection finishing time.

14 Claims, 8 Drawing Figures

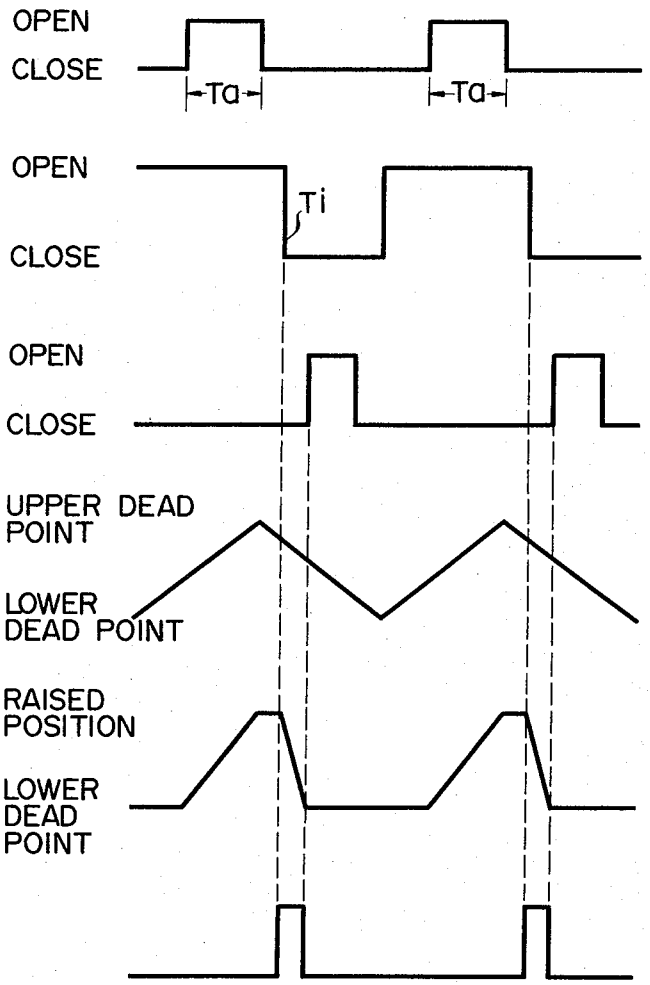
FIG. 3A METERING VALVE
FIG. 3B TIMING VALVE
FIG. 3C DISCHARGE VALVE
FIG. 3D PUMPING PLUNGER
FIG. 3E INJECTION PLUNGER
FIG. 3F INJECTION

FUEL INJECTION APPARATUS

BACKGROUND OF THE INVENTION

This invention relates to a fuel injection apparatus used to inject fuel into a cylinder of a Diesel engine.

A fuel injection apparatus generally comprises a fuel tank, fuel supply pump, fuel filter, fuel injection pump, injection nozzle etc., and is used to inject liquid fuel, under pressure, into a cylinder of a Diesel engine. The fuel supply pump compresses liquid fuel from a fuel tank and sends it to a fuel injection pump. A fuel injection pump usually comprises a cylinder and a plunger and has a suction inlet and an escape hole. The plunger can be rotated relative to the cylinder with its axis as a center. A spiral cutout is formed around the outer peripheral surface of the plunger. The plunger is reciprocally moved in synchronism with the operation of an engine and compresses fuel sent from the fuel supply pump, the fuel is injected from the injection nozzle into the cylinder of the engine. In this way the fuel is supplied to the engine and the injection time and injection amount are controlled according to the operation states of the engine. This is done by rotating the plunger by the use of a rack etc. and varying a positional relation of the spiral cutout to the suction inlet and the escape hole of the cylinder. With this arrangements, the starting and/or ending of fuel injection is likely to be quickened or slowed down. To cope with this situation, an electromagnetic valve is provided, as disclosed in Japanese Patent Disclosure (KOKAI) No. 54-50726, to accurately control the fuel injection time and fuel injection amount when fuel is injected into the engine. If, in this case, electromagnetic pulses to the electromagnetic valve are electrically controlled, the fuel injection time and fuel injection amount are accurately determined, making them commensurate with the operation states of the engine. In this method, however, high-pressure fuel is directly loaded to the electromagnetic valve and it is therefore necessary to provide a value capable of withstanding the high pressure. Even when a high pressure electromagnetic valve is provided, however, the reliability of the valve is detrimentally effected by injecting fuel under high pressure. To overcome this drawback, a method is adopted to provide a restrictor partway of a passage for connecting the electromagnetic valve to the pump chamber, and to, thusly, lower the fuel pressure transmitted to the electromagnetic valve. If such a restrictor is used, however, the "cutting of the fuel injection", i.e. a tendency of the fuel injection amount to be gently decreased at the final phase of fuel injection, fails to take a proper pattern and thus it takes a longer time until the injection of a predetermined amount of fuel is completed. This is the reason why the restrictor cannot be used.

In the above-mentioned method using the electromagnetic valve, an amount of fuel to be injected is determined by the valve opening time, i.e. the fuel injection time, making it necessary to accurately controllably open and close the electromagnetic valve for a very short period of time. Moreover, the electromagnetic valve requires an excellent response characteristic and high finishing accuracy is also required to prevent a variation in the amount of fuel to be injected.

SUMMARY OF THE INVENTION

It is accordingly the object of this invention to provide a fuel injection apparatus which can readily control a fuel injection time and fuel injection amount commensurate with the operation states of an engine, can perform a better "cutting of the fuel injection", and can obviate the need for providing component parts able to withstand high pressure.

According to this invention there is provided a fuel injection apparatus comprising:

(1) a unit fuel injector for injecting fuel into a cylinder of an internal combustion engine including;

(a) a housing having a first bore and a second bore, (b) a pumping plunger reciprocally inserted into the first bore and driven by and in synchronism with the engine, (c) a pump chamber defined by the first bore and pumping plunger, (d) an injection plunger reciprocally inserted into the second bore, (e) an injection pump chamber defined by the second bore and one end of the injection plunger, (f) a compression chamber defined by the second bore and the other end of the injection plunger and communicating with the pump chamber, (g) an injection nozzle communicating with the injection pump chamber for injecting the fuel into the cylinder, (h) a feed port formed in the housing and operatively opened into the pump chamber for supplying the fuel into the pump chamber, (i) a timing port formed in the housing and operatively opened into the pump chamber, said timing port being formed at such a position as to be closed by the pumping plunger after the feed port has been closed by the pumping plunger, (j) a fuel supply passage communicating with the injection pump chamber for supplying the fuel to the injection pump chamber, and (k) a check valve provided in the fuel supply passage to for checking a back flow of the fuel which is supplied to the injection pump chamber, (2) a fuel tank;

(3) a pump for pressurizing the fuel from the fuel tank to a predetermined pressure level;

(4) metering means permitting communication between the pump and the fuel supply passage for metering the fuel supplied to the injection pump chamber;

(5) timing control means communicating with the timing port through a timing passage for setting a fuel injection start time by closing the timing passage;

(6) an orifice provided in the timing passage;

(7) means communicating with the feed port for supplying the fuel to the pump chamber when the pumping plunger is raised;

(8) an escape port formed in the housing and opened into the pump chamber, said escape port being provided in such a position as not to be blocked by the pumping plunger; and (9) dischrage means provided on a return passage leading to the escape hole for opening the return passage at the end of a fuel injection operation by the injection plunger and discharging the fuel in the pump chamber and compression chamber.

BRIEF DESCRIPTION OF THE DRAWINGS

FIGS. 3A to 3F show a time chart.

DETAILED DESCRIPTION OF THE PREFERRED EMBODIMENTS

Figure 1:
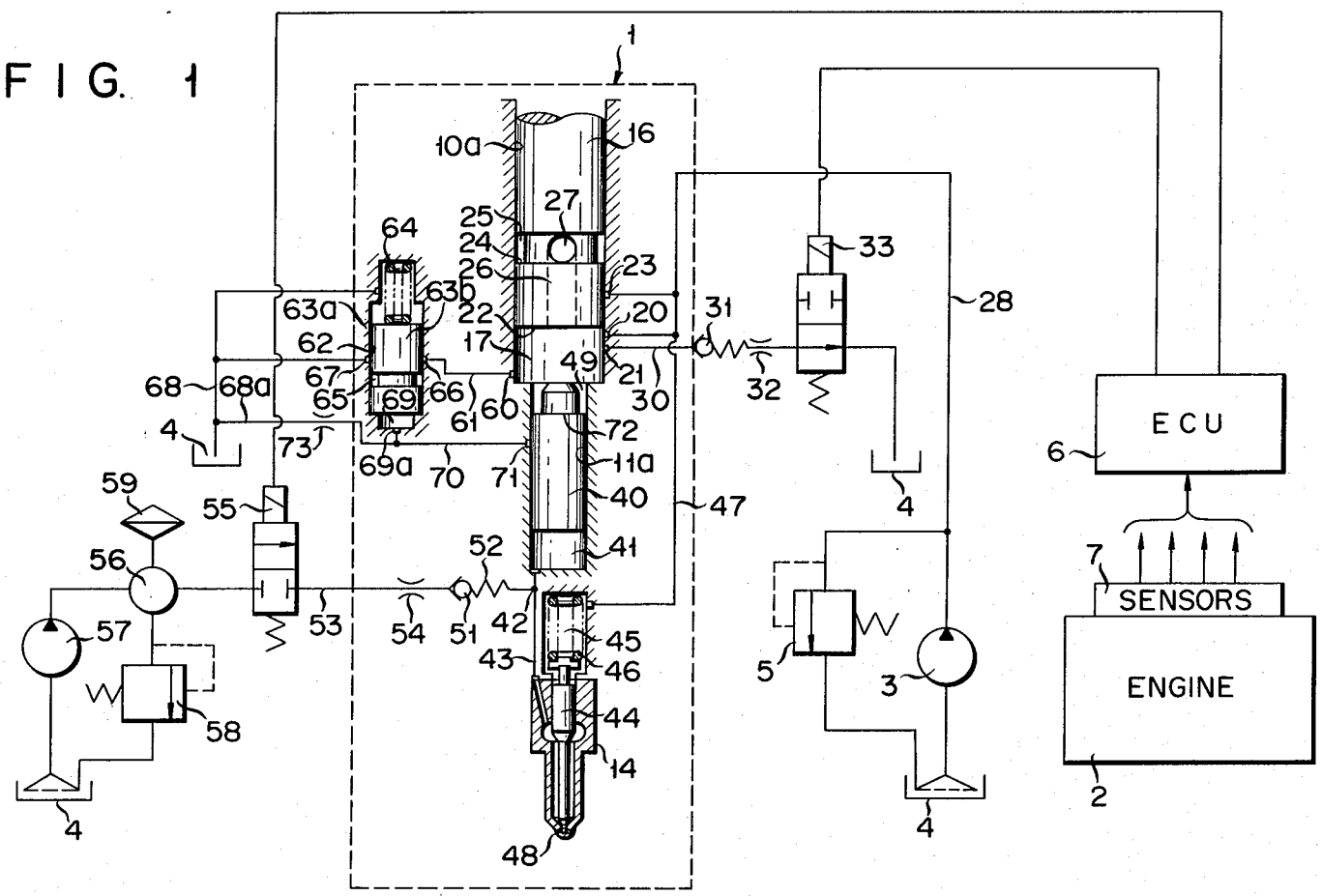
FIG. 1 is a schematic view generally showing a fluid path system of a fuel injection apparatus according to one embodiment of this invention.
Figure 2:
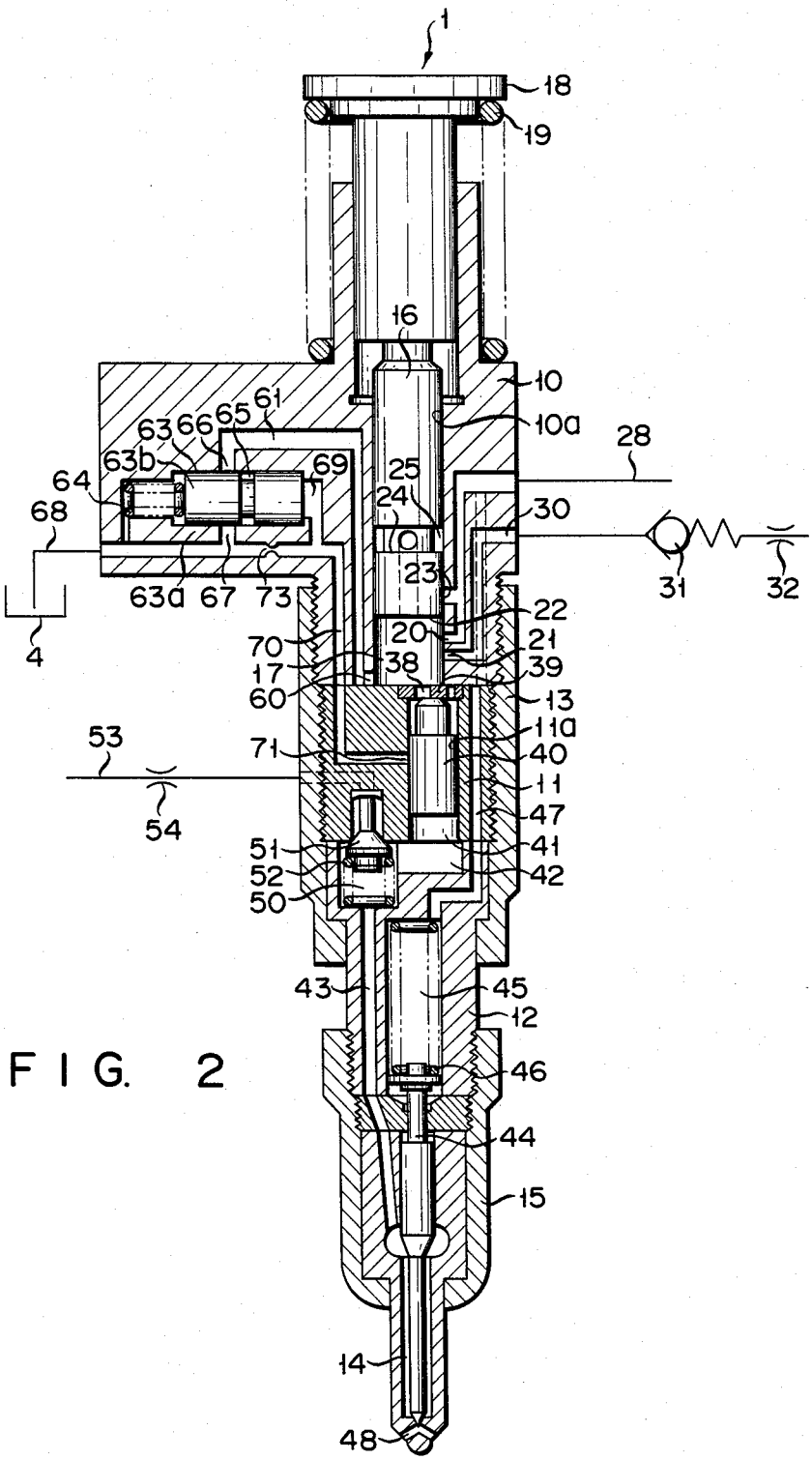
FIG. 2 is a cross-sectional view showing a unit fuel injector which is a major section of the fuel injection apparatus.

FIG. 1 shows a unit fuel injector 1. The detailed arrangement of the unit fuel injector is shown in FIG. 2 and the unit fuel injector is incorporated into a housing 1*a*. In FIG. 2, 10 shows a fuel pumping cylinder as a first cylinder; 11, a fuel injetion cylinder as a second cylinder; and 12, a nozzle holder. The cylinders 10 and 11 and nozzle holder 12 are arranged in a coaxial direction and are coupled by a holder nut 13 to each other. An injection nozzle 14 is attached through a retaining nut 15 to the nozzle holder 12.

A pumping plunger 16 as a first plunger is slidably inserted into a bore (first bore) 10*a* of the cylinder 10. Within the bore 10*a* of the cylinder 10 a pump chamber 17 is defined by the cylinder 10 and one end of the plunger 16. The outer end of the plunger 16 is engaged with a cam follower 18. The cam follower 18 is engaged with a cam (not shown) operated in synchronism with the rotation of an engine 2, and pressed in a downward direction as shown. The plunger 16 is such that it is pushed upwardly by a follower spring 19 when the cam is retracted. The inner wall of the bore 10*a* has a feed port 20 opened in a manner to confront the pump chamber 17 and a timing port 21 located at a position lower than that of the feed port 20. The inner wall of the cylinder 10 has a first escape port 23 located in a position higher than that of the feed port 20. The plunger 16 has a timing lead 22 for opening and closing the feed port 20 and timing port 21 and a spill lead 24 for opening and closing the escape port 23. An annular groove 25 is formed in the outer peripheral surface of the plunger 16 and the plunger 16 has an communication holes longitudinal and internal holes 26 and 27 (see FIG. 1) for permitting the pump chamber 17 to communicate with the annular groove 25.

The supply port 20 and first escape port 23 both communicate with a discharge end of a first fuel pump 3, through a feed passage 28. The first fuel pump 3 driven by the engine 2 sucks fuel from a fuel reservoir 4 as a fuel source and, after compressing it, sends it to the feed passage 28. A pressure adjusting relief valve 5 is connected to the feed passage 28 at the discharge side of the pump 3, and the maximum pressure of the fuel is restricted by the relief valve 5. The timing port 21 is connected to a fuel return passage 30 for fluid communication. A timing check valve 31, a restriction 32 and a timing electromagnetic valve 33 are sequentially disposed on the return passage 30. The return passage 30 is connected through these members to the fuel reservoir 4. The timing electromagnetic valve 33 constitutes a blocking means, whereby the return passage 30 is closed at the maximum injection time of the engine 2 to control the fuel injection time as will be later described.

A fuel injection plunger 40, as a second plunger, is slidably inserted into a bore 11*a* (second bore) of the cylinder 11. The upper area of the bore 11*a* of the cylinder 11 provides a compression chamber 49 defined by the upper end of the plunger 40. The chamber 49 communicates with the pump chamber 17. A stopper member 39 is fitted in the upper open end portion of the cylinder 11 and has a communication hole 38. The upper area of the second bore 11*a* communicates with the pump chamber 17 through the communication hole 38 of the stopper member 39. The plunger 40 abuts against the stopper member 39 to provide a upper dead point. Since the pump chamber 17 communicates with the chamber 49, the plunger 40 can be moved up and down by the hydraulic pressure of the pump chamber 17. The cylinder 11 is formed to have an inner diameter sufficiently smaller than that of the cylinder 10 and thus the plunger 40 is moved more rapidly than the plunger 16.

At the lower side of the jet plunger 40 an injection pump chamber 41 is formed within the bore 11*a* of the cylinder 11. A metering port 42 is formed on the lower end of the injection pump chamber 41. The metering port 42 communicates through a pumping passage 43 with the injection nozzle.

As shown in FIG. 2, the nozzle 14 is of a known type adapted to open and close an injection hole 48 by a needle valve 44. The needle valve 44 is urged such that it is moved in a closing direction by a nozzle spring 46 in a nozzle spring chamber 45. The nozzle spring chamber 45 communicates with the feed passage 28 through a leakage passage 47.

The metering port 42 communicates with an amount adjusting valve spring chamber 50. An amount adjusting valve 51 and a spring 52 are disposed in the amount adjusting valve spring chamber 50.

The valve 51 permits, or shuts off, communication between an amount adjusting passage 53 and the metering port 42. An amount adjusting electromagnetic valve 55, as a second electromagnetic valve, is disposed on the amount adjusting passage 53 through a balance orifice 54 so as to adjust for any variation between the cylinders. The electromagnetic valve 55 permits a supply of the adjusted fuel to the pump chamber 41. The electromagnetic valve 55 is coupled to a second fuel supply pump 57 through a surge tank 56. The pump 57 sucks the fuel from the fuel reservoir 4 and, after compressing it, supplies the fuel which is adjusted by a pressure adjusting relief valve 58 to a predetermined pressure to the surge tank 56. Reference numeral 59 is an accumulator.

A second escape port 60 is opened at the lower end of the pump chamber 17. The escape port 60 is coupled through a discharge passage 61 to a metering means as will be described later. The discharge passage 61 communicates with a discharge valve chamber 62 which is provided in a cylinder member 63*a* for a discharge valve 63. The valve chamber 62 is formed at one side of the pumping cylinder 10 and a discharge plunger 63*b* is slidably inserted into the valve chamber 62. The plunger 63*b* of the discharge valve 63 is urged by a coil spring 64. An annular groove 65 is provided in the plunger 63*b* and permits, or shuts off, communication between a spill port 66 in the discharge passage 61 and a discharge port 67. The discharge port 67 communicates with the fuel reservoir 4 through a spill passage 68. At the lower end of the discharge valve chamber 62 a pressure introducing chamber 69 is formed which is defined by the lower end of the plunger 63*b*. An inflow port 69*a* is opened into the pressure introducing chamber 69. The inflow port 69*a* communicates with a pressure introducing port 71 through an introducing passage 70. The pressure introducing port 71 is opened into the inner wall of the cylinder 11 and a metering lead 72 is provided at the upper end of the plunger 40. When the plunger 40 is moved at a predetermined down stroke, the pressure introducing port 71 is opened to permit high-pressure fuel in the compression chamber 49 to be supplied into the pressure introducing chamber 69. The introducing passage 70 communicates with a spill passage 68*a* which in turn communicates with the fuel reservoir 4. An orifice 73 is provided in the spill passage 68*a*.

The timing electromagnetic valve 33 and amount adjusting electromagnetic valve 55 are connected to an electronic control unit 6, such as a computer, as shown in FIG. 1, whereby they are opened and closed in response to the operational conditions of the engine. Reference numeral 7 shows various sensors 7. The sensors sense the operation states of the engine 2, such as the rotation speed, load, acceleration opening, suction temperature and cooling water temperature etc. The electronic control unit 6 computes data obtained by the sensors and sends an output signal for opening and closing the electromagnetic valves 33 and 55.

The operation of the fuel injection apparatus will now be explained below.

When the electromagnetic valve 55 is opened by the electronic control unit 6 for a predetermined time period Ta as shown in FIG. 3A, fuel pumped under a predetermined pressure from the second fuel supply pump 57 is supplied to the metering port 42 through the balance orifice 54 and amount adjusting valve 51. Since the metering port 42 communicates with the pump chamber 41, when the electromagnetic valve 55 is opened, the fuel is supplied from the fuel supply pump 57 to the pump chamber 41. Since the amount of fuel in the pump chamber 41 is adjusted by an opening time Ta of the electromagnetic valve 55 which is determined by the electronic control unit 6, an amount of fuel adjusted according to the operation states of the engine is supplied to the pump chamber 41. At this time, the plunger 40 is raised as shown in FIG. 3E and the pressure introducing port 71 is closed.

As shown in FIG. 3D, the pumping plunger 16 is pushed downward from the upper dead point by a cam, not shown in synchronism with the rotation of the engine. At this time, the timing electromagnetic valve 33 is in the open state. For this reason, the pump chamber 17 is filled with fuel sent from the supply pump 3, but it is escaped through the timing port 21 and return passage 30. At this time, however, the plunger 63*b* of the discharge valve 63 is pushed by the coil spring 64 and the annular groove 65 is located away from the spill port 66 and discharge port 67, thus shutting off communication between the ports 66 and 67. For this reason, the fuel is not escaped from the escape port 60.

When the timing lead 22 closes the feed port 20 as the pumping plunger 16 is moved downward, the fuel in the pump chamber 17 is escaped through the timing port 21 only.

An optimal fuel injection timing Ti (see FIG. 3B) corresponding to the rotation speed of the engine, load etc. is computed by the electronic control unit 6, thereby closing the timing electromagnetic valve 33. As a result, the fuel is not discharged from the timing port 21 and the fuel in the pump chamber 17 is compressed by the pumping plunger 16. Under this compression, the plunger 40 in the cylinder 11, the compression chamber 49 of which communicates with the pump chamber 17, is increased in speed by an effective area ratio between the pumping cylinder 10 and the cylinder 11, permitting it to be pushed down. For this reason, the plunger 40 compresses the adjusted fuel in the pump chamber 41 and sends it through the pumping passage 43 to the injection nozzle 14. Since in the injection nozzle 14 the needle valve 44 opens the injection hole 48 against the nozzle spring 46, the fuel sent to the pumping passage 43 starts to be injected from the injection hole into the cylinders of the engine 2 as shown in FIG. 3F.

The continued downward movement of the pumping plunger 16 causes the injection plunger 40 to be moved to permit the fuel to continue to be injected. When the metering lead 72 of the plunger 40 opens the pressure introducing port 71, the fuel sent from the pump chamber 17 into the compression chamber 49 is supplied through the pressure introducing port 71 into the pressure introducing chamber 69. The discharge valve 63 receives pressure in the pressure introducing chamber 69 and is pushed up against the coil spring 64 to permit communication between the spill port 66 and the discharge port 67. As a result, as shown in FIG. 3C the fuel in the pump chamber 17 starts to be discharged through the escape port 60, discharge passage 61, spill port 66, annular groove 65 and discharge port 67 into the fuel reservoir 4. This stops the pushing down of the injection plunger 40 by high-pressure fuel in the pump chamber 17, thereby stopping the injection of the fuel.

Since the pressure of the pressure introducing chamber 69 is held to a certain level, the discharge valve 63 is not immediately returned to the original position.

When the fuel in the pump chamber 17 is so discharged through the second escape hole 60, the injection plunger 40 ceases to be pushed. Since the pressure in the pump chamber 41 is maintained to a relatively high level due to the closure of the needle valve 44 in the injection nozzle 14 while a greater pressure drop occurs in the pump chamber 17, the injection plunger 40 is raised. As the injection plunger 40 is raised, the capacity of the pump chamber is rapidly incresed and the fuel injection of the injection nozzle 14 is rapidly cut by a "sucking back" effect of the pump chamber corresponding to a possible pressure drop.

When the pumping plunger 16 is further lowered to permit the groove 25 to communicate with the first escape port 23, the fuel in the pump chamber 17 is also discharged from the first escape port 23. When the pumping plunger 16 is moved down to lower dead points and stopped, the pressure in the spill passage 68 is lowered and the pressure in the pressure introducing chamber 69 is lowered, causing the discharge valve 63 to be moved back to the original position to permit the escape hole to be closed.

When the pumping plunger 16 is moved by the follower spring 19 at the up stroke, the fuel from the fuel supply pump 57 is adjusted by the opening function of the electromagnetic valve 55 and sent into the pump chamber 41.

When the pumping plunger 16 opens the feed port 20, the fuel is sent from the first fuel pump 3 to the pump chabmer 17. The next fuel injection is performed as mentioned above.

Since in the above-mentioned embodiment the fuel is adjusted over a time period in which the electromagnetic valve is opened, and sent into the pump chamber 41, an amount of fuel corresponding to the operation states of the engine is controlled positively and readily. The fuel injection timing can be set by closing the return passage 30 by the timing electromagnetic valve 33 and a setting corresponding to the operation states of the engine can be smoothly effected with high precision. The electromagnetic valve 55 prevents a back flow of high-pressure fuel at the pump chamber 41 by the valve 51 and the high-pressure fuel does not act upon the electromagnetic valve 55. It is therefore unnecessary to avoid a valve 55 which can withstand high pressure. A fuel pressure reduced by the timing check valve 31 and timing orifice 32 acts upon the timing electromagnetic valve 33 and thus no high pressure acts upon the timing electromagnetic valve 33. As the timing electromagnetic valve is closed by the metering lead 22 before the fuel in the pump chamber 17 reaches maximum pressure, the timing electromagnetic vavle 33 is protected against a possible breakage etc.

In this embodiment, because only the amounts of fuel initially required on the engine side is adjusted to be in readiness for the pump chamber 41, the amount of fuel injected is positively metered and the cutting of the fuel injection is controlled by the injection plunger 40, resulting in a high-precision fuel injection apparatus.

Although in the above-mentioned embodiment two pumps (3, 57) are used as the fuel supply pumps, this invention can be put to practice with one pump.

In place of the amount adjusting valve and timing valve, for example, use is made of, a plunger which is mechanically driven by an internal combustion chamber.

According to this invention an amount of fuel to be injected is administered by the amount adjusting device and the fuel injection timing is controlled by a blocking mechanism, permitting the control to be effected with high precision. The adjusted amount of fuel is, after temporarily being stored in the injection pump chamber, pumped and thus the positive cutting of the injection fuel is carried out. The amount adjusting device and the blocking mechanism for controlling the fuel injection time period can be made free from any influence of a high-pressure fuel, permitting these units to be designed without increasing their ability to withstand high pressure.

What is claimed is:

1. A fuel injection apparatus comprising:

(1) a unit fuel injector for injecting fuel into a cylinder of an internal combustion engine including;

(a) a housing having a first bore and a second bore, (b) a pumping plunger reciprocally inserted into the first bore and driven by and in synchronism with the engine, (c) a pump chamber defined by the first bore and pumping plunger, (d) an injection plunger reciprocally inserted into the second bore, (e) an injection pump chamber defined by the second bore and one end of the injection plunger, (f) a compression chamber defined by the second bore and the other end of the injection plunger and communicating with the pump chamber;

(g) an injection nozzle communicating with the injection pump chamber for injecting the fuel into the cylinder, (h) a feed port formed in the housing and operatively opened into the pump chamber for supplying the fuel into the pump chamber, (i) a timing port formed in the housing and operatively opened into the pump chamber, said timing port being formed at such a position as to be closed by the pumping plunger after the feed port has been closed by the pumping plunger, (j) a fuel supply passage communicating with the injection pump chamber for supplying the fuel to the injection pump chamber, and (k) a check valve provided in the fuel supply passage for checking a back flow of the fuel which is supplied to the injection pump chamber, (2) a fuel tank;

(3) a pump for pressurizing the fuel from the fuel tank to a predetermined pressure level;

(4) metering means permitting communication between the pump and the fuel supply passage for metering the fuel supplied to the injection pump chamber;

(5) timing control means communicating with the timing port through a timing passage for setting a fuel injection start time by closing the timing passage;

(6) an orifice provided in the timing passage;

(7) means communicating with the feed port for supplying the fuel to the pump chamber when the pumping plunger is raised;

(8) an escape port formed in the housing and opened into the pump chamber, said escape port being provided in such a position as not to be blocked by the pumping plunger; and (9) discharge means provided on a return passage leading to the escape port for opening the return passage at the end of a fuel injection operation by the injection plunger and discharging the fuel in the pump chamber and compression chamber.

2. A fuel injection apparatus according to claim 1, in which said pumping plunger comprises an annular groove formed in the outer peripheral surface thereof such that it is located partway, and a communication hole for permitting communication between the pump chamber and the annular groove, said annular groove communicating with the feed port when the pumping plunger substantially reaches a lower dead point.

3. A fuel injection apparatus according to claim 1, in which the inner diameter of the first bore is greater than that of the second bore.

4. A fuel injection apparatus comprising:

(1) a unit fuel injection for injecting fuel into a cylinder of an internal combustion engine including:

(a) a housing having a first bore and a second bore, (b) a pumping plunger reciprocally inserted into the first bore and driven by and in synchronism with the engine, (c) a pump chamber defined by the first bore and pumping plunger, (d) an injection plunger reciprocally inserted into the second bore, (e) an injection pump chamber defined by the second bore and one end of the injection plunger, (f) a compressing chamber defined by the second bore and the other end of the injection plunger and communicating with the pump chamber, (g) an injection nozzle communicating with the injection pump chamber for injecting the fuel into the cylinder, (h) a feed port formed in the housing and operatively opened into the pump chamber for supplying the fuel into the pump chamber, (i) a timing port formed in the housing and operatively opened into the pump chamber, said timing port being formed at such a position as to be closed by the pumping plunger after the feed port has been closed by the pumping plunger, (j) a fuel supply passage communicating with the injection pump chamber for supplying the fuel to the injection pump chamber, and (k) a check valve provided in the fuel supply passage for checking a back flow of the fuel which is supplied to the injection pump chamber, (2) a fuel tank;

(3) a pump for pressurizing the fuel from the fuel tank to a predetermined pressure level;

(4) metering means permitting communication between the pump and the fuel supply passage for metering the fuel supplied to the injection pump chamber;

(5) timing control means communicating with the timing port through a timing passage for setting a fuel injection start time by closing the timing passage;

(6) an orifice provided in the timing passage;

(7) means communicating with the feed port for supplying the fuel to the pump chamber when the pumping plunger is raised;

(8) an escape port formed in the housing and opened into the pump chamber, said escape port being provided in such position as not to be blocked by the pumping plunger; and (9) discharge means provided on a return passage leading to the escape port including:

(l) a housing having a third bore, (m) a spill port operatively opened into the inner wall of said third bore and communicating with the return passage, (n) a discharge port opened into the inner wall of the third bore, (o) a first spill passage leading to the discharge port and to the fuel tank, and (p) a discharge plunger reciprocally inserted into the third bore and adapted to shut off communication between both the ports when the fuel is injected and to permit communication between both the ports at the end of the fuel injection operation thereby opening the return passage, at the end of a fuel injection operation, and discharging the fuel in the pump chamber and compression chamber.

5. A fuel injection apparatus according to claim 4, in which said pumping plunger comprises an annular groove formed in the outer peripheral surface thereof such that it is located partway, and a communication hole for permitting communication between the pump chamber and the annular groove, said annular groove communicating with the feed port when the pumping plunger substantially reaches a lower dead point.

6. A fuel injection apparatus according to claim 4, in which the inner diameter of the first bore is greater than that of the second bore.

7. A fuel injection apparatus according to claim 4, wherein said discharge means further comprising:

a pressure introducing chamber defined by a space in the third bore and one end of the discharge plunger;

an inflow port opened into the pressure introducing chamber;

a pressure introducing port opened into the second bore, said pressure introducing port being formed in such a position that it is closed by the injection plunger during the fuel injection operation and opened by the injection plunger at the end of the fuel injection operation;

an introducing passage for permitting communication between the inflow port and the pressure introducing port, in which at the end of the fuel injection operation the pressure introducing chamber receives fuel compression from the pressure chamber to operate the discharge plunger; and a second spill passage communicating the introducing passage with the fuel tank.

8. A fuel injection apparatus according to claim 7, further comprising an orifice provided on the second spill passage.

9. A fuel injection apparatus according to any one of claims 7, 8 and 4–6, further comprising a check valve provided on the timing passage such that it is located between the orifice and the timing port.

10. A fuel injection apparatus according to any one of claims 7, 8 and 4–6, further comprising a surge tank provided on the fuel supply passage such that it is located between the pump and the metering means.

11. A fuel injection apparatus according to any one of claims 7, 8 and 4–6, further comprising a surge tank provided on the fuel supply passage such that it is located between the pump and the metering means, and an accumulator connected to the surge tank to damp a surge of fuel in the surge tank and maintain a fuel pressure constant.

12. A fuel injection apparatus according to any one of claims 7, 8 and 4–6, further comprising another orifice provided on the fuel supply passage located between the metering means and said check valve.

13. A fuel injection apparatus according to any one of claims 7, 8 and 4–6, in which said timing control means is an electromagnetic valve adapted to close said timing passage according to the operation states of an internal combustion engine.

14. A fuel injection apparatus according to any one of claims 7, 4 and 5, in which said metering means is an electromagnetic valve adapted to open and close said fuel supply passage according to the operation states of an internal combustion engine.

* * * * *